United States Patent [19]

Sterner, Jr.

[11] 4,283,883

[45] Aug. 18, 1981

[54] WINDOW ASSEMBLY HAVING REMOVABLE SASH

[75] Inventor: Maurice E. Sterner, Jr., York, Pa.

[73] Assignee: Schlegel Corporation, Rochester, N.Y.

[21] Appl. No.: 109,408

[22] Filed: Jan. 3, 1980

[51] Int. Cl.[3] ..... E05D 15/22

[52] U.S. Cl. ..... 49/194; 49/454; 49/459

[58] Field of Search ..... 49/176, 183, 194, 453–459; 160/89–91

[56] References Cited

U.S. PATENT DOCUMENTS

| | | | |
|---|---|---|---|
| 3,122,797 | 3/1964 | Segre | 49/453 X |
| 3,377,747 | 4/1968 | Donkin | 49/453 X |
| 3,529,381 | 9/1970 | Grossman | 49/183 |
| 3,805,452 | 4/1974 | Scott | 49/454 |
| 3,837,118 | 9/1974 | Goss, Jr. et al. | 49/453 X |
| 4,167,835 | 9/1979 | Nobes et al. | 49/453 X |
| 4,187,643 | 2/1980 | Sconzo | 49/455 |

*Primary Examiner*—Philip C. Kannan

*Attorney, Agent, or Firm*—Cushman, Darby & Cushman

[57] ABSTRACT

In a window assembly of the kind including at least two window sashes having inwardly facing surfaces and outwardly facing surfaces, said sashes being fitted into a perimeter frame formed by spaced apart longitudinal members joined at their ends to the ends of spaced apart transverse members, and means mounting at least one of the sashes for sliding movement in said frame in a longitudinal direction between a closed position and an open position and for inward movement relative to the frame, the improvement comprising a sash retainer mounted on each longitudinal frame member for longitudinal sliding movement relative to the respective frame member, each retainer having a longitudinal dimension about equal to the longitudinal dimensions of said slidable sash and being slidable between a first position coextensive with said slidable sash and a second position in which the retainer is longitudinally offset from said slidable sash, each retainer having a longitudinal fin overlying the inwardly facing surface of the respective longitudinal edge of said slidable sash when said sash and said retainer are coextensive to thereby provide support and sealing said surface; and manually releasable latches for releasably connecting said slidable sash to said retainers.

10 Claims, 4 Drawing Figures

WINDOW ASSEMBLY HAVING REMOVABLE SASH

This invention relates to storm windows having a slidable sash and in particular it relates to constructions which reduce infiltration of air past the sash.

The prior art and the present invention are hereinafter discussed in terms of windows having one or more vertically slidable sashes but it will be understood that the concepts apply equally to horizontally slidable sashes.

BACKGROUND

A common form of storm window in present day use includes a sash which is vertically slidable in a perimeter frame for the purpose of opening the window, the frame being mounted to the exterior or interior of the building in overlying relationship to a prime window. In one well-known type of construction the sash is a removable tilt-type sash, by which is meant that the sash can be removed from the frame for cleaning by a manual tilting operation. Specifically, each of the vertical side rails of the sash is provided near its upper end with a laterally projecting pin which rides in a vertical channel formed by the side members of the perimeter frame. The lower portion of the sash is releasably latched to the side members of the frame by means of manually operable slide bolts or the like. Upon retraction of the slide bolts the sash can be manually tilted about the axes of the pins; that is, the lower edge of the sash can be swung inwardly into the building and upwardly toward the operator. When the lower edge of the sash has been elevated a substantial distance it is a simple matter to remove the sash from the frame by lowering one side rail of the sash relative to the other so that the pins no longer reside in the channels in the frame.

It is inherent in the type of window construction summarized above that the perimeter frame does not include a fixed channel which receives the vertical side rails of the storm sash when in its closed position, as is typical for a slidable sash in a prime window. That is, if the storm sash is to be removed by tilting, the conventional frame cannot form a fixed vertical flange or web which overlies those surfaces of the sash side rails which face inwardly toward the interior of the building. The result is that there is considerable leakage of air past the sash even though weather stripping is usually provided between the laterally facing surfaces of the side rails and the frame and between the outwardly facing surfaces of the side rails and the frame. Thus there is no weather stripping along the inner faces of the sash side rails, and in addition the lack of support for these faces may permit the sash to bow slightly toward the interior of the building under the influence of wind, thereby decreasing the effectiveness of the existing weather stripping.

The window of the present invention overcomes the above-summarized disadvantages by means of special vertically movable sash retainers which provide support and sealing for a movable sash when in its down position. The sash retainers are slidable upwardly to permit removal of the sash from the retainers and from the perimeter frame. Pivot pins for the sash are not required.

A search of United States patents conducted for the purpose of determining the patentability of the present invention identified U.S. Pat. Nos. 806,105, 875,300, 2,212,221, 3,080,620, 3,105,576, 3,199,154, 3,529,381, 4,057,936, 4,151,682 and Re. 24,077. Of these, only U.S. Pat. No. 3,529,381 was regarded as being of interest. That patent discloses a single-hung storm window having a fixed upper sash and a vertically slidable lower sash which is arranged to swing or tilt inwardly toward the interior of the building for cleaning purposes. The arrangement differs from the conventional arrangement summarized above in that the slidable sash remains pivotally connected to the perimeter frame during cleaning. The slidable sash is swingable by being pivoted at its upper extremity to two vertically elongated carriages which move with the sash. When the sash is in a down position it is prevented from swinging by fixed fins or channel flanges formed by the fixed vertical side members of the frame. When the sash is moved to its up position the lower end of the sash resides above the ends of the fins so that the sash can be swung inwardly. There is no provision for removing the other sash.

SUMMARY OF THE INVENTION

The present invention is directed to a modified perimeter frame and sash construction in which a slidable sash retainer is releasably connected to each of the two longitudinal side members of the sash, the arrangement being such that the retainers can assume either a sash-retaining position or a non-retaining position. In their non-retaining position the sash can be removed from the perimeter frame for cleaning. In their sash-retaining position the retainers prevent bowing of the sash during windy weather. In addition, they provide a space between their outwardly facing surfaces and the inwardly facing surfaces of the sash side members, into which space can be inserted weather stripping material. As a result of these two features the leakage of air past the sash is much reduced.

In addition to reducing air leakage the construction of the invention is compatible with double-hung sashes in a manner which also permits the normally stationary upper sash to be mounted in the frame for removal.

DETAILED DESCRIPTION

Figure 1:
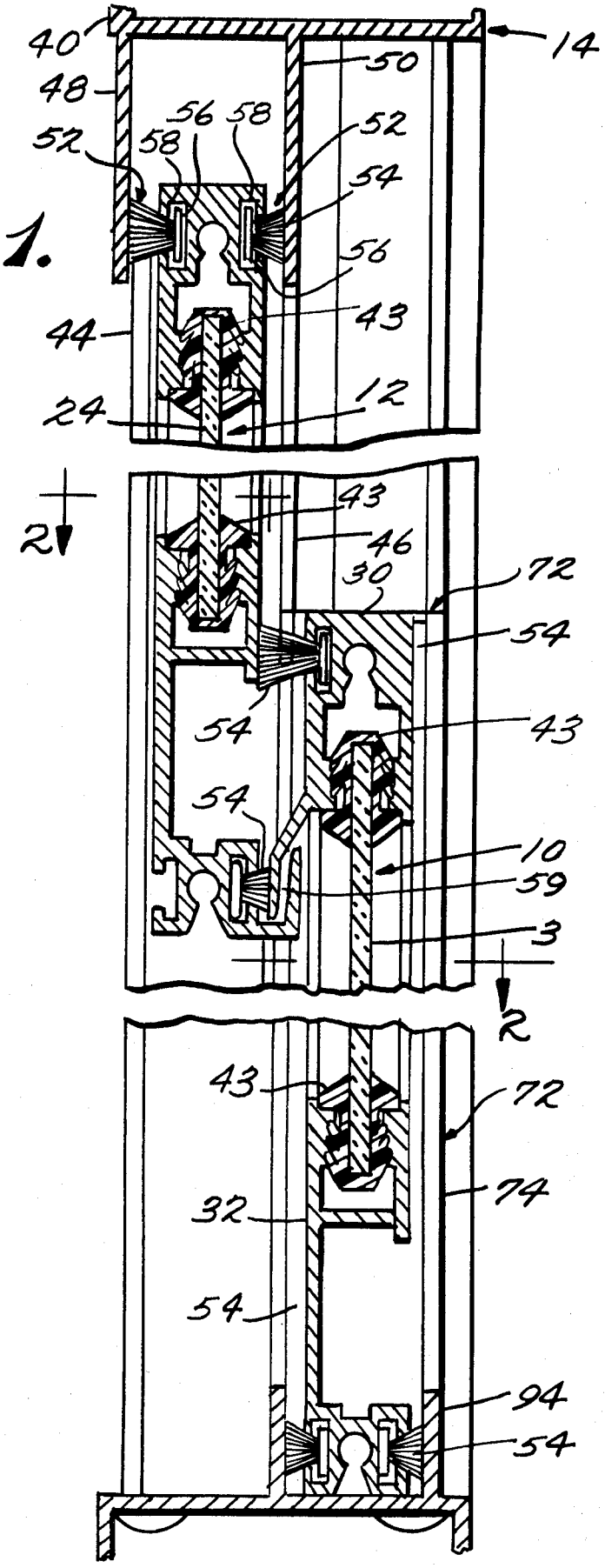
FIG. 1 is a vertical sectional view, with some parts omitted for clarity, of a window assembly embodying the principles of the present invention.
Figure 2:
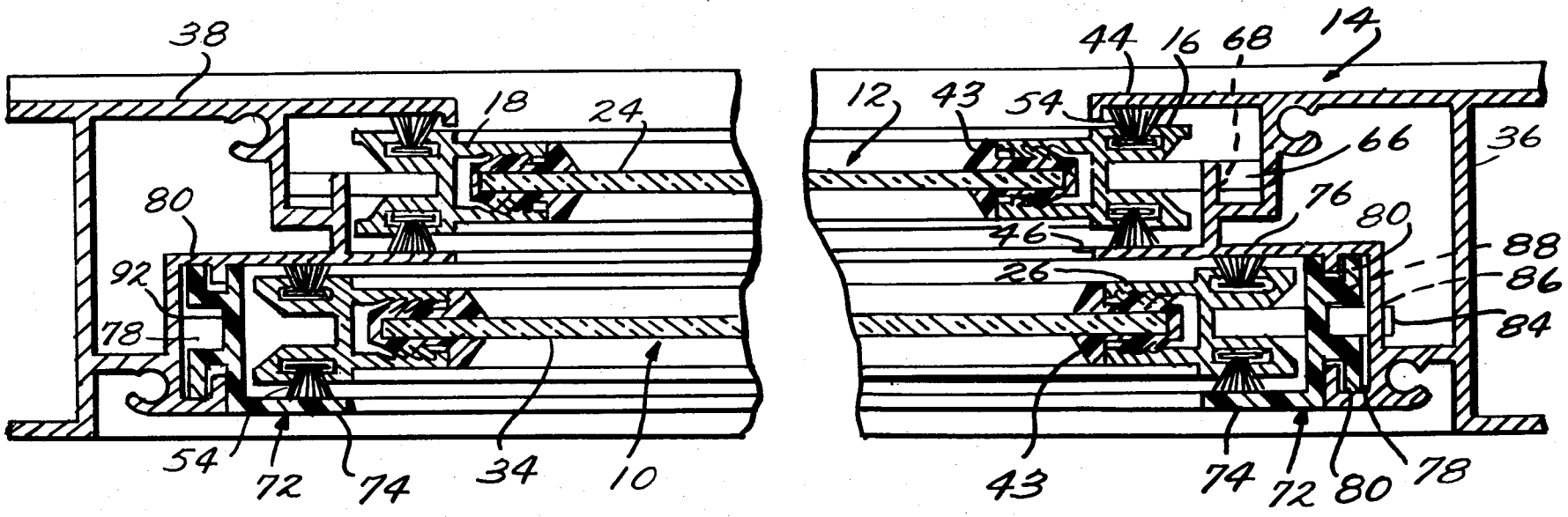
FIG. 2 is a horizontal sectional view taken generally on the line 2—2 in FIG. 1.
Figure 3:
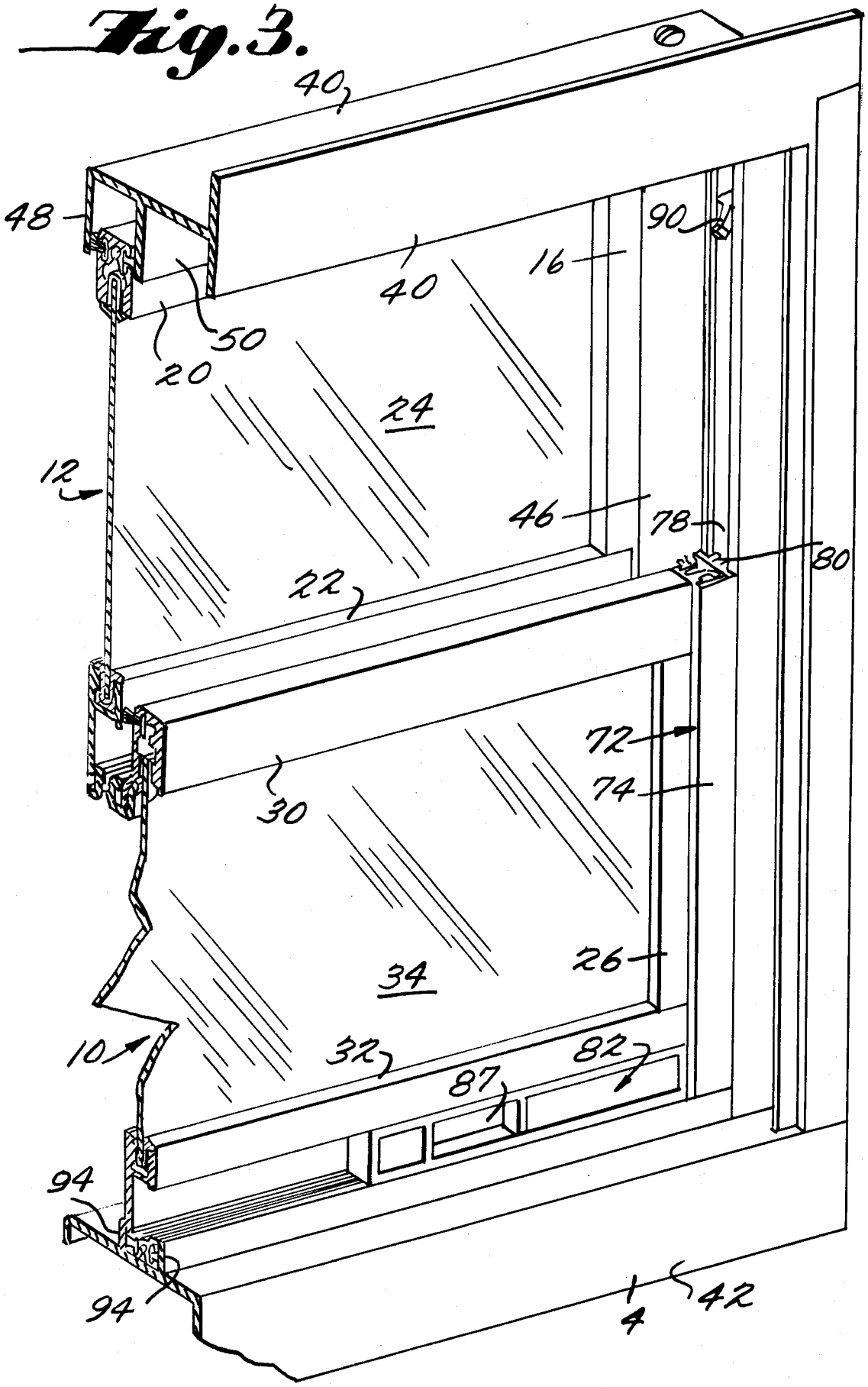
FIG. 3 is a broken-away perspective view of the window of FIGS. 1 and 2.

The window illustrated in the drawings is a double-hung storm window adapted to be secured to the exterior of a building in overlying relationship to a prime window. The basic components of the window are a lower sash 10 and an upper sash 12, both mounted in a perimeter frame 14 for vertical sliding movement. The upper sash 12 includes two-spaced apart parallel longitudinal or vertical members 16,18 joined to two transverse or horizontal members 20,22 and a transparent light or pane 24. Similarly the lower sash 10 includes two longitudinal members 26,28, two transverse members 30,32 and a transparent pane 34. The perimeter frame 14 is constructed of longitudinal vertical side members 36,38 and upper and lower horizontal transverse members 40,42. The sash members and frame members, as is conventional, may be made from extruded aluminum sections. The edges of the panes 24 and 34 are fitted into their respective sash members in any convenient manner, preferably with the use of channel shaped gaskets 43 which may be of known construction.

The upper sash 12 when in its up position is retained in the perimeter frame partially by the upper frame member 40 and by the frame side members 36 and 38. Each of the frame side members 36 and 38 includes a channel construction, such as that illustrated by spaced-apart parallel flanges 44 and 46. The outer flange 44 extends the entire length of the frame side member 36. The vertical dimension of the inner flange 46 is no greater than the vertical dimension of the upper sash 12, in order to permit removal of the upper sash 12 from the perimeter frame 14 as described later. The upper frame member 40 includes two depending flanges 48 and 50 which form a channel for the upper transverse member 20 of the upper sash 12.

The inner and outer surfaces of the upper sash member 20 and the inner and outer surfaces of the sash side members 16 and 18 are fitted with strips of weather stripping material 52, preferably of the pile type which includes a resilient fibrous pile 54 protruding from a base 56. The various sash members are formed with channels 58 to receive and retain the weather stripping in a manner such that the pile 54 extends into contact with the flanges 44, 46, 48 and 50. Additional weather stripping 52 is provided on the surface of a channel in the lower sash member 22 to cooperate with a flange 59 depending from the sash member 30 of the lower sash 10.

When in its up position the upper sash 12 is prevented from moving downwardly by a pair of latch assemblies 64 mounted on the lower sash member 22. Each latch assembly 64 includes a latch bolt 66 or the like which is slidable laterally into and out of a notch 68 or hole formed in the respective frame side member 36 or 38. Conveniently the latch bolts 66 are spring biased laterally outward, and the latch assembly 64 includes thumb or finger recesses 70 facing inwardly into the building for engagement by the thumbs or fingers of an occupant.

A screen, not shown, may be mounted in or on the perimeter frame 14, in coextensive relationship with the lower sash 10, if desired.

The present invention relates primarily to the mounting of the lower sash 10 in a manner to improve air tightness. The mounting of the lower sash 10 is compatible with, but does not require a slidable or removable upper sash.

The mounting arrangement for the lower sash 10, in accordance with the principles of the invention, includes two vertically movable sash retainers 72 which provide support and sealing for the inner surface of the lower sash 10 when the latter is in its down position. The retainers 72 are preferably made of rigid synthetic plastics material such as polyvinyl chloride. Conveniently the retainers 72 have a shape which enables them to be formed by extrusion. One essential feature of the retainers is that they each include a vertical fin 74 which lies in the plane of the window and which overlies essentially the entire length of the inner surface of the adjacent side member 26 or 28 of the lower sash 10. The fin 74 in cooperation with a parallel wall portion 76 of the respective frame side member 36 or 38 forms a channel for receiving the sash side member 26 or 28. Alternatively the retainer 72 itself may include a wall portion which cooperates with the fin 74 to provide a channel for the sash side member 26 or 28.

The vertical dimensions of the retainers are about equal to the vertical dimension of the lower sash 10. This permits the retainers 72 to assume a raised position such that the lower sash 10 in a down position can be removed from the perimeter frame 14, as described hereinafter. It is intended that the retainers 72 be more or less permanently attached to the perimeter frame 14 while at the same time being readily slidable in vertical directions. This can be achieved by providing vertical interlocking complementary surfaces on the retainers 72 and on the respective frame side member 36 and 38. In the illustrated assembly each side member 36 and 38 is provided with a vertical channel 78 which is box-shaped in cross-section. Each retainer 72 is provided with two legs 80, L-shaped in cross-section, which are retained in the respective channel 78 and which are vertically slidable therein. The plastic material of which the retainers 72 are made slides easily in contact with the frame side members 36 and 38.

The lower sash 10, like the upper sash 12 in the illustrated embodiment, is provided with a pair of latch assemblies which permit latching of the sash against vertical movement. Each assembly 82 for the lower sash 10 is mounted on the lower sash member 32 and includes a latch bolt 84 or the like which is slidable laterally into and out of a notch 86 or hole formed in the respective frame side member 36 or 38 at a location to releasably latch the lower sash 10 in its closed position. Other notches, not shown, may be provided in the frame side members 36 and 38 at locations which permit the lower sash 10 to be releasably latched in intermediate positions. The retainers 72 are provided with holes 88 to permit the latch bolts 84 to pass through the retainers 72 into the notches 86. In their fully retracted positions the latch bolts 84 do not reside in the holes 88 in the retainers 72; this permits the lower sash 10 to slide independently of the retainers 72 when desired, as when removing the lower sash 10 by an operation described hereinafter. Conveniently the latch bolts 66 are spring-biased laterally outward and thumb or finger recesses 87 are provided in the assemblies 82 for engagement by the thumbs or fingers of an occupant.

Weather stripping material 52 is provided on the inner and outer surfaces of the lower sash member 32, on the inner and outer surfaces of the sash side members 26 and 28 and on the outer surface of the upper sash member 20. In the closed position of the lower sash 10 a seal is formed between the lower sash member 32 and two upstanding flanges 94 on the lower frame member 42. Other seals are formed between the opposed sash members 22 and 30 and between sash members 26, 28 and the wall 76. As in the case of the upper sash 12 the weather stripping 52 is of the pile type and is fitted into channels 58 in the respective sash members. The weather stripping material 52 on the inner surface of the sash side members 26 and 28 is effective due to the presence of the fin 74 on each of the sash retainers 72. As described previously it is not conventional to include weather stripping material in this location because conventionally there is no flange overlying the inner surfaces of the lower sash side members when the lower sash is in a closed position. Thus the fin 74 of the present invention serves to support the lower sash 10 against inward bowing and to provide a sealing surface to reduce infiltration of air. With respect to bowing, as might occur during windy weather, it is apparent that such bowing would permit the weather stripping material 52 on the outer surface of the sash side members 26 and 28 to move away from the wall 76 thereby reducing or destroying the seal.

Figure 4:
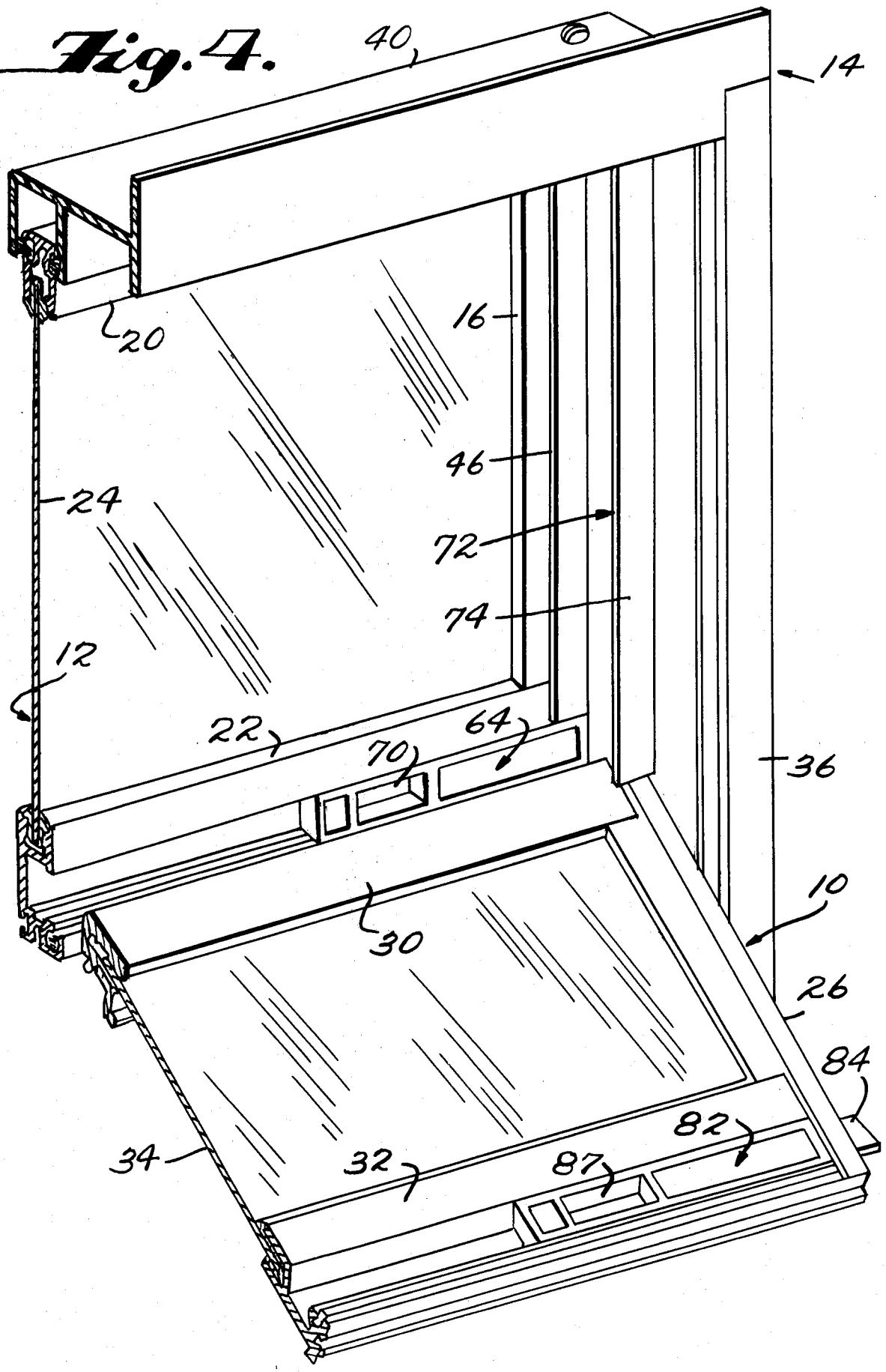
FIG. 4 is a broken-away perspective view of the window showing the lower sash tilted inwardly into the building.

The procedure for removing the lower sash 10 is as follows. Beginning with the lower sash 10 in a closed and latched position and the prime window open, the occupant of the building places thumbs or fingers in the recesses 87 of the latch assemblies 82 and retracts the latch bolts 84 from the notches 86 in the frame side members 36 and 38. The bolts 84 are not fully retracted, however, so that their end portions while free of the notches 86 still reside in the holes 88 in the sash retainers 72. The lower sash 10 is then raised vertically to a full up position in which it is generally coextensive with the upper sash 12. The retainers 72 are carried upwardly due to engagement of the bolts 84 in the holes 88. To ensure that the retainers 72 will remain in the up position when the sash 10 is subsequently moved downwardly a releasable latch is provided between each retainer 72 and its respective frame side member 36 or 38. In the illustrated embodiment the latch is a simple spring clip attached to the respective frame member 36 or 38 and having a downwardly extending resilient arm 90. As the retainers 72 are moved to their up positions a wall portion 92 of each retainer 72 slides under the respective arm 90 and is thereby releasably clamped to the respective frame member 36 or 38. The spring clip or other latch may be unnecessary if there is sufficient friction between the retainers 72 and the frame members 36 and 38 to hold the retainers up while the sash 10 is moved down. The bolts 84 are then further retracted so as to be clear of the holes 88. With the bolts 84 held in this position the sash 10 is lowered to almost its full down position, leaving the sash retainers 72 clamped in an up position by the spring arms 90. In this position the sash side members 26 and 28 reside below and clear of the fins 74 of the sash retainers 72. The sash 10 can therefore be removed from the perimeter frame 14 by pulling it toward the interior of the building, provided that the latch bolts 84 remain retracted. Removal of the sash 10 is illustrated in FIG. 4.

To remove the upper sash 12 the building occupant first places thumbs or fingers in the recesses 70 of the latch asemblies 64 and retracts the bolts 66 from the notches 68 in the frame side members 36 and 38. Next the upper sash is slid vertically downwardly to a position such that it resides below the lower ends of the flanges 46. The upper sash 12 can then be moved inwardly in the manner described above with respect to the lower sash 10. The upper sash 12 is thus removable from the perimeter frame through the opening left by removal of the lower sash 10.

To replace the sashes 12 and 10 the above steps are reversed.

What is claimed is:

1. In a window assembly of the kind including at least two window sashes having inwardly facing surfaces and outwardly facing surfaces, said sashes being fitted into a perimeter frame formed by spaced apart longitudinal members joined at their ends to the ends of spaced apart transverse members, and means mounting at least one of the sashes for sliding movement in said frame in a longitudinal direction between a closed position and an open position and for inward movement relative to the frame, the improvement comprising a sash retainer mounted on each longitudinal frame member for longitudinal sliding movement relative to the respective frame member, each retainer having a longitudinal dimension about equal to the longitudinal dimension of said slidable sash and being slidable between a first position coextensive with said slidable sash and a second position in which the retainer is longitudinally offset from said slidable sash, each retainer having a longitudinal fin overlying the inwardly facing surface of the respective longitudinal edge of said slidable sash when said sash and said retainer are coextensive to thereby provide support and sealing said surface; and manually releasable latches for releasably connecting said slidable sash to said retainers.

2. A window assembly as in claim 1 wherein each of said sash retainers is slidably mounted on the respective longitudinal frame member by means of longitudinally-extending complementary grooves and ribs on each retainer and the respective frame member, said complementary grooves and ribs interlocking with each other in a manner to permit longitudinal sliding of the retainer.

3. A window assembly as in claim 1 or claim 2 wherein said sash retainers are constructed of synthetic plastics material.

4. A window assembly as in claim 1 or claim 2 including means mounting the other of said sashes for longitudinal sliding movement in said frame and for inward movement relative to said frame.

5. A window assembly as in claim 1 or claim 2 including weather stripping material between the inwardly facing surface of each longitudinal edge of said slidable sash and the adjacent surface of said fin, said weather stripping material having a length essentially the same as the length of said slidable sash.

6. A window assembly as in claim 4 wherein said weather stripping material is a resilient pile material having a backing surface and a pile surface.

7. A storm window assembly comprising an upper sash and a lower sash both fitted into a frame construction which is adapted to be attached to a building coextensive with a prime window, said frame construction having two parallel longitudinal portions each of which includes inner and outer vertical flanges horizontally spaced apart to form a channel in which a vertical edge of the upper sash is accommodated when the upper sash is in its up position, each inner flange having a length approximately equal to the vertical dimension of the upper sash, a lower sash retainer carried by each longitudinal portion of said frame, each retainer being slidable vertically relative to said frame and each retainer including a vertical fin which overlies the inner surface of respective vertical edge of the lower sash when the lower sash is in its down position, the vertical length of each retainer being approximately equal to the vertical length of the lower sash; and means for releasably latching said retainers to the lower sash whereby said retainers can be raised in said frame along with raising of the lower sash whereupon the lower sash may be unlatched from said retainers and then lowered and removed from said frame in an inward direction.

8. A storm window assembly as in claim 7 wherein said sash retainers are constructed of synthetic plastics material.

9. A storm window assembly as in claim 7 including weather stripping material between the inwardly facing surface of each longitudinal edge of said slidable sash and the adjacent surface of said fin, said weather stripping material having a length essentially the same as the length of said slidable sash.

10. A storm window assembly as in claim 9 wherein said weather stripping material is a resilient pile material having a backing surface and a pile surface.

* * * * *